US006805421B2

(12) United States Patent
Eck et al.

(10) Patent No.: US 6,805,421 B2
(45) Date of Patent: Oct. 19, 2004

(54) METHOD AND DEVICE FOR ALIGNING PRINT HEADS

(75) Inventors: Rainer Eck, Gochsheim (DE); Michael Koblinger, Kolitzheim (DE); Karl Erich Albert Schaschek, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/416,160

(22) PCT Filed: Oct. 15, 2001

(86) PCT No.: PCT/DE01/03945

§ 371 (c)(1),
(2), (4) Date: May 15, 2003

(87) PCT Pub. No.: WO02/40280

PCT Pub. Date: May 23, 2002

(65) Prior Publication Data

US 2004/0036727 A1 Feb. 26, 2004

(30) Foreign Application Priority Data

Nov. 17, 2000 (DE) ..... 100 57 062

(51) Int. Cl.[7] ..... B41J 29/38

(52) U.S. Cl. ..... 347/12; 347/41; 347/42; 347/40; 347/19; 347/13

(58) Field of Search ..... 347/9, 12, 13, 347/5, 19, 40, 41

(56) References Cited

U.S. PATENT DOCUMENTS

| | | | | | |
|---|---|---|---|---|---|
| 4,675,696 | A | * | 6/1987 | Suzuki | 346/46 |
| 5,428,375 | A | * | 6/1995 | Simon et al. | 347/12 |
| 5,719,602 | A | | 2/1998 | Hackleman et al. | |
| 5,838,343 | A | * | 11/1998 | Chapin et al. | 347/22 |
| 6,048,048 | A | | 4/2000 | Gregoire | |
| 6,655,771 | B2 | * | 12/2003 | Matsumoto et al. | 347/13 |

FOREIGN PATENT DOCUMENTS

| | | |
|---|---|---|
| EP | 257 570 | 3/1988 |
| EP | 665 114 | 8/1995 |
| GB | 2 220 385 | 6/1988 |
| GB | 2 349 607 | 1/2000 |
| JP | 10-100396 | 4/1998 |
| JP | 2000-963 | 1/2000 |

* cited by examiner

*Primary Examiner*—Stephen Meier
*Assistant Examiner*—Ly T Tran
(74) *Attorney, Agent, or Firm*—Jones Tullar & Cooper, PC

(57) ABSTRACT

The invention relates to a method and a device for aligning print heads (5) in relation to continuous printed material. According to the invention, to align the print heads (5) in relation to one another, the latter are displaced transversally to the direction of printing (6) and to align the print heads (5) in the direction of printing, the injection times of the print heads are temporally controlled. The print heads (5) can be precisely and simply aligned by the mechanical adjustment of only one axis.

8 Claims, 1 Drawing Sheet

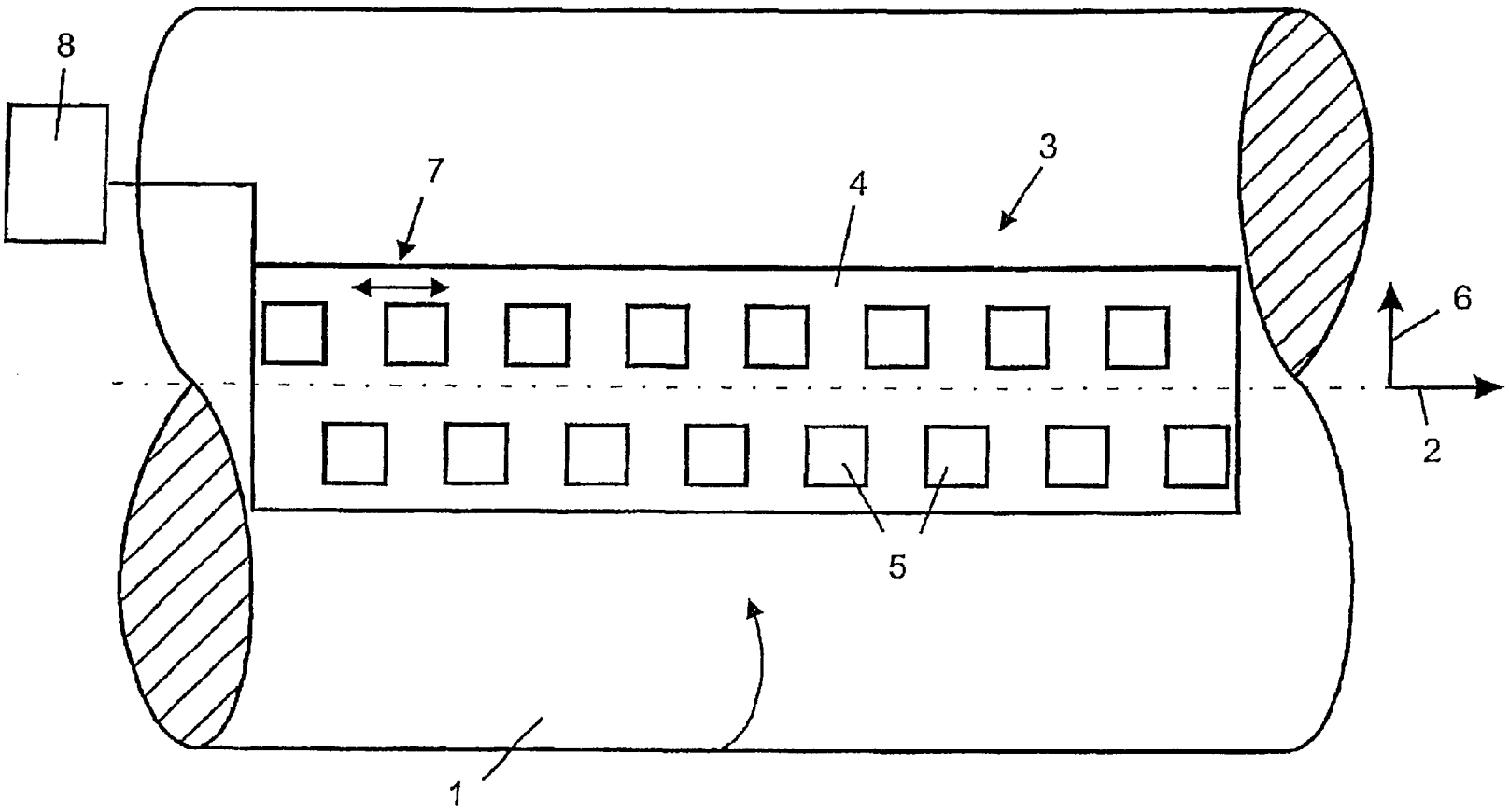
6
2
3
4
5
7
1
8

METHOD AND DEVICE FOR ALIGNING PRINT HEADS

FIELD OF THE INVENTION

The present invention is directed to a method and to a device for aligning a print head in relation to the material to be printed.

BACKGROUND OF THE INVENTION

In the course of placing images on offset printing plates, it is known to use multiple head printing systems which have a plurality of ink jet print heads. The print heads spray the appropriate medium on the printing plate, which is customarily mounted on a printing plate cylinder and which moves in the course of the printing process. In order to achieve a printed image of high quality on the printing plate and ultimately on the printed product, it is necessary to align the print heads with an accuracy of a few $\mu$m in respect to each other. However, conventional print heads do not have surfaces with which they could be aligned by the use of stops. To position such print heads on a desired spot, it is therefore necessary to compare the actual position of the print image with the intended position and to displace the print heads accordingly.

GB 2 349 607 A shows a printing device with a plurality of print heads which are arranged offset in respect to each other. These print heads are arranged inclined in the radial direction in relation to a printing cylinder.

U.S. Pat. No. 6,048,048 discloses a printing device with several print heads. These print heads are aligned with each other transversely to the printing direction.

SUMMARY OF THE INVENTION

The object of the present invention is directed to providing a method and a device for the alignment of print heads.

In accordance with the present invention, this object is attained by changing the shot or actuation time of the print head. To accomplish the alignment of several print heads in respect to each other at least one of the print heads is moved relative to another of the print heads in a direct transverse to the printing direction. A time control device is usable to control the timing of the shot or actuation of the print head to align the print head in the printing direction.

The advantages which can be obtained by the present invention lie, in particular, in that, instead of displacing the print head in two axes for appropriately adjusting the print image sprayed by the print head on the material to be imprinted, such as an offset printing plate, the alignment of the print head, or of its resultant print image, can be achieved more simply, in accordance with the present invention, by a combination of a mechanical alignment in one axis and by a time control of the shot of the print head. Thus, for aligning the print head transversely with respect to the printing direction, the print head is moved, while for aligning the print head in the printing direction, the time of the shot from the print head is changed. The term print direction in this context is understood to be the movement direction of the material to be imprinted relative to the print heads. If printing plates mounted on rotating printing plate cylinders are provided as the material to be imprinted, the print direction extends perpendicularly or vertically with respect to the axis of rotation of the printing plate cylinder. The change in the time of the shot is usefully made as a function of the print speed, i.e. as a function of the running speed of the material to be imprinted. If the time of the shot from the print head is delayed, the material to be imprinted passes farther underneath the print head and vice versa, so that an adjustment of the position of the printed image on the material to be imprinted, in the printing direction, is achieved.

Several print heads of a multiple head printer can, in particular, be aligned with each other, wherein at least one of the print heads can be displaced for the alignment of the print heads transversely to the printing direction. To accomplish the alignment of the print heads in the printing direction, the time of the shot from at least one print head can be controlled. The displacement of the print head, as well as the change of the time of the shot, can be performed individually for each print head, or possibly can also be performed for groups of print heads together.

The print heads are, in an advantageous manner, individually displaced. They are moved exclusively for achieving an alignment of the printed image transversely to the printing direction. The adjustment of the printed image is considerably simplified by this. When performing a displacement of the print head in only one direction, it is not necessary to keep in mind that a displacement of the printed image in the other axis could possibly also occur. The latter is adjusted by the timed control of the time of the shot.

Preferably, all of the print heads which are displaced, are displaced in the same direction, i.e. along parallel axes. This simplifies the alignment of the print heads in relation to each other.

The print heads can be displaced transversely to the printing direction. In this way, the alignment transversely to the printing direction is disassociated from the alignment in the print direction, so that the alignment process as a whole is simplified.

In accordance with another preferred embodiment of the present invention, the print heads can each be moved, or pushed along an axis which forms an acute angle in respect to the printing direction. A resultant offset of the print heads in the printing direction can be compensated for by a corresponding change of the time of the shots from the respective print head. In connection with obliquely placed print heads in particular, i.e. print heads, whose nozzle row was placed obliquely in relation to the printing direction in order to permit a closer arrangement of the print heads in relation to each other, the displacement of the print heads can take place parallel with the oblique position, i.e. parallel in relation to the longitudinal orientation of the print heads defined by the row of printing nozzles. It is possible by such oblique placement in an arrangement of the print heads in several rows, for print heads of different rows to be fastened on a mutual, obliquely placed print head holder. A displacement can be performed in the longitudinal direction of the holder connecting the print heads.

In an advantageous manner, an adaptation of the printing grid distance in the printing direction to the printing nozzle distance transversely to the printing direction can be performed by the time control of the individual nozzle shots as a function of the printing speed.

The alignment can be achieved, in an advantageous manner, by the use of a print head positioning device which is usable for exclusively aligning the print head transversely to the printing direction. A time control is used for controlling the time of the shot of the print head for aligning it, and the resultant printed image, in the printing direction.

The positioning device is preferably a single-axis displacement device, by use of which the print head can be displaced along one axis. The displacement axis of the positioning device can be arranged transversely to the printing direction. In accordance with a preferred embodiment of the present invention, the print head positioning device has a displacement axis which forms an acute angle with the printing direction. The time control device is embodied in such a way that the resultant offset of the print head in the printing direction is compensated for by a change of the time of the shot, at which shot time, the respective print head shoots the individual drops.

In a further development of the present invention, the device has a plurality of print head positioning devices for aligning several print heads in relation to each other. The print heads are preferably adjustable individually and separately from each other. The control device can be configured in such a way that the shot time, or times, of the print heads can be set individually and/or in groups.

BRIEF DESCRIPTION OF THE DRAWINGS

A preferred embodiment of the present invention is represented in the sole drawing and will be described in greater detail in what follows. The sole drawing FIGURE shows a schematic representation of a multi-head inkjet printing system with a device for aligning the print heads of the printing system in accordance with a preferred embodiment of the present invention.

DESCRIPTION OF THE PREFERRED EMBODIMENT

A printing plate cylinder 1, on which a printing plate, for example an offset printing plate, is capable of being mounted, rotates in the conventional manner around its longitudinal axis 2. A multi-head inkjet printing system 3 is provided and is usable to place images, which are not specifically shown, on the printing plate. The inkjet printing system 3 has a printing beam 4, which extends parallel with the longitudinal axis 2 of the printing plate cylinder 1 and which is located opposite the circumferential side of the cylinder 1.

A plurality of print heads 5 are seated on the printing beam 4, which print heads 5 are embodied as ink jet heads and which spray the printing liquid in drops on the printing plate cylinder 1. The print heads 5 are arranged in two rows, wherein the print heads 5 in the two successive rows are arranged offset transversely in relation to the printing direction 6 with respect to each other. The printing direction 6 is determined by the direction of rotational movement of the printing plate cylinder 1 and extends vertically, or perpendicularly with respect to the longitudinal axis 2 of the printing plate cylinder 1.

The print heads 5 are each displaceably seated on the print beam 4. The print heads 5 can each be displaced individually in relation to the printing beam 4 along one axis by use of a print head positioning device 7, so that the position of the respective print head 5 is changed transversely to the printing direction 6, i.e. in a direction parallel with the longitudinal axis 2. The printed image can be set or positioned transversely to the printing direction 6 by this movement of each print head 5 along the printing beam 4.

A time control device 8, which controls the shot time of each of the individual print heads 5, or of the individual printing nozzles, is provided for the purpose of correcting, or of aligning, the print heads 5 in the printing direction 6.

The prior problem of positioning, or of aligning several print heads 5 in relation to each other in a plane is simplified by the separation of the two axes to be positioned in accordance with the present invention. One axis is defined by the direction in which the material to be imprinted moves. This axis can be aligned by a skillful time control of the time of the shot of the individual printing nozzles. The other axis is located transversely in respect to the printing direction, in the depicted configuration parallel with the longitudinal axis 2 the printing plate cylinder. It is therefore possible to mechanically align this axis alone in a simpler way.

Although the preferred embodiment describes the printing system in terms of the placement of images on printing plates, the described alignment can also be used in other print head printing systems for different printing applications in which the position of the print heads must be aligned.

This printing device applies a medium for changing the coating, and in which an additional coating can be applied, or properties of a coating can be changed, of a printing forme, in particular a planographic printing forme of a printing press.

While a preferred embodiment of a method and device for aligning print heads in accordance with the present invention has been set forth fully and completely hereinabove, it will be apparent to one of skill in the art that various changes in, for example the overall size of the printing plate cylinder, the mechanism used to secure the printing plate to the cylinder, and the like could be made without departing from the true spirit and scope of the present invention which is to be limited by the following claims.

What is claimed is:

1. A method for aligning a print head in relation to a material to be printed by the print head including:

supporting the material to be printed for movement in a printing direction at a printing speed;

providing at least one print head;

supporting said at least one print head for movement along a print head movement axis;

disposing said print head movement axis forming an acute angle with said printing direction;

providing a time of shot control for said at least one print head;

using said time of shot control for aligning said at least one print head in said printing direction;

aligning said at least one print head by moving said at least one print head along said print head movement axis; and compensating for a resultant offset of said moved print head in said printing direction by changing a time of shot of said moved print head using said time of shot control.

2. The method of claim 1 further including accomplishing said moving of said at least one print head along said print head movement axis while said at least one print head is not printing.

3. The method of claim 1 wherein said at least one print head is displaced along one axis.

4. The method of claim 1 further including providing a plurality of print heads, and supporting said plurality of print heads for individual movement along said print head movement axis, and providing a separate time of shot control for each of said plurality of print heads.

5. The method of claim 4 further including supporting said plurality of print heads each for movement along a separate print head movement axis, said separate print head movement axes being parallel.

6. The method of claim 1 further including providing a printing grid distance in said printing direction and providing a printing nozzle distance transversely to said printing direction and adapting said printing grid direction to said printing nozzle distance by controlling said time of shot control as a function of said printing speed.

7. A device for the alignment of a print head in relation to a material to be imprinted comprising:

means to support a material to be printed for movement in a printing direction;

a plurality of print heads;

a print head positioning device supporting said plurality of print heads for selective relative movement of each of said plurality of print heads along a print head displacement axis, said print head displacement axis forming an acute angle with said printing direction; and a time control device adapted to control a time of shot of each of said plurality of print heads, each said time control device being operable separately and in concurrence with other ones of said time control devices wherein a resultant offset of at least one of said plurality of printing heads resulting from a movement in said printing direction is compensated by a change in a time of shot of said at least one of said plurality of printing heads using said time control device.

8. The device of claim 7 wherein each said print head positioning device is a single axis displacement device.

* * * * *